US006588628B2

(12) United States Patent
Abplanalp et al.

(10) Patent No.: US 6,588,628 B2
(45) Date of Patent: Jul. 8, 2003

(54) AEROSOL VALVE ASSEMBLY

(76) Inventors: Robert Henry Abplanalp, Ten Hewitt Ave., Bronxville, NY (US) 10708; Christian Bayer, 19 Faraway Rd., Armonk, NY (US) 10504; Randy Joseph Flynn, 489 Rossland Road West, Oshawa, Ontario (CA), L1J 3H1

( * ) Notice: Subject to any disclaimer, the term of this patent is extended or adjusted under 35 U.S.C. 154(b) by 0 days.

(21) Appl. No.: 10/020,465

(22) Filed: Nov. 30, 2001

(65) Prior Publication Data

US 2003/0102328 A1 Jun. 5, 2003

(51) Int. Cl.[7] ..... B65D 83/14
(52) U.S. Cl. ..... 222/105; 222/389; 222/402.24
(58) Field of Search ..... 222/105, 389, 222/394, 402.1, 402.24

(56) References Cited

U.S. PATENT DOCUMENTS

| | | | | | |
|---|---|---|---|---|---|
| 1,934,225 | A | * | 11/1933 | Candor | 222/387 |
| 3,225,967 | A | * | 12/1965 | Heimgartner | 222/183 |
| 3,257,035 | A | * | 6/1966 | Jones | 222/82 |
| 3,610,481 | A | * | 10/1971 | Marraffino | 222/402.24 |
| 3,675,832 | A | * | 7/1972 | Ruscitti | 222/402.24 |
| 3,982,674 | A | * | 9/1976 | Mildern | 222/402.21 |
| 4,211,347 | A | * | 7/1980 | Mildern | 222/402.18 |
| 4,471,893 | A | * | 9/1984 | Knickerbocker | 222/402.22 |
| 4,477,001 | A | * | 10/1984 | Galia | 222/402.1 |
| 6,305,582 | B1 | * | 10/2001 | Tsutsui et al. | 222/402.24 |

FOREIGN PATENT DOCUMENTS

DE 2 128 981 * 12/1971

* cited by examiner

*Primary Examiner*—Ehud Gartenberg
*Assistant Examiner*—Patrick Buechner
(74) *Attorney, Agent, or Firm*—Kilgannon & Steidl

(57) ABSTRACT

An aerosol valve assembly, lacking a return spring and dip tube, has a valve housing and a valve body with a lower portion, an intermediate portion and a valve stem. A gasket in a stem groove seals one or more orifice openings into the valve stem except on valve actuation. The valve housing has a lower wall with a central opening for the valve body lower portion to enter to stabilize the vertically acting valve; and, a plurality of product delivery openings positioned about the central opening. A stroke-limiting surface on the valve body prevents the gasket from completely escaping the stem groove on valve actuation. When valve actuation ceases, the valve is returned to closed position by the gasket acting against the stem groove, and the product acting against the valve body bottom portion and the lower surface of the valve body intermediate portion.

15 Claims, 6 Drawing Sheets

AEROSOL VALVE ASSEMBLY

FIELD OF THE INVENTION

The present invention relates to aerosol valve assemblies to dispense products from pressurized aerosol containers, and more particularly relates to easy-to-open valve assemblies for dispensing viscous and semi-viscous products from such containers including compartmentalized containers.

BACKGROUND OF THE INVENTION

In a conventional form of aerosol valve assembly, a vertically acting aerosol valve is opened to release product in the aerosol container by downwardly depressing an actuator attached to the top of the upstanding stem of the aerosol valve body. When the actuator is released, the valve is closed by a metal spring acting upwardly against the valve body. The valve stem has an upwardly extending discharge passage, a groove extending about the stem periphery, a lateral valve orifice (one or more) extending through the stem wall into the groove, and a stem-encircling sealing gasket for fitting into the groove and closing the lateral orifice except when the valve is actuated to depress the stem lateral orifice below the gasket.

There are a number of recognized disadvantages to using the conventional metal spring. The spring has a significant upward force, requiring a significant downward force by the user to open and maintain open the aerosol valve. Further, the metal spring provides well-known corrosion problems in the presence of certain products dispensed from aerosol containers. In addition, the metal spring adds significant cost to the aerosol valve assembly and requires a separate assembly operation. Despite all of these disadvantages, the metal return springs continue to be used in the vast majority of aerosol valve assemblies because a sufficiently satisfactory alternative has not been found.

In certain instances, resilient plastic members have been adopted to replace the metal spring, the plastic springs being separate from or integral with the valve housing and/or valve body of the aerosol valve assembly. Such plastic springs avoid corrosion, but can be difficult and expensive to mold, require a significant user force to open and maintain open the aerosol valve, and may be more subject to failure than metal springs. Representative prior art for such plastic springs is found in U.S. Pat. Nos. 3,675,832 (Ruscitti); 4,471,893 (Knickerbocker); 4,477,001 (Galia); 5,895,029 (LaCout); and German Offenlegungsschrift 2128981 (1971).

Various attempts have been made to eliminate valve return springs, whether metal or plastic, but such attempts have been inadequate and/or overly complicated in concept and construction. One such attempt is shown in U.S. Pat. No. 3,982,674 (Mildern) wherein upon valve opening, fluid or powder (i.e., essentially non-viscous) products flow up a dip tub to and up a central stem of the aerosol valve. Propellant acts against a diaphragm or a piston portion of the valve housing, in combination with low pressure in a chamber directly above the piston portion and the stem gasket flex in its groove, to close the valve after actuation. U.S. Pat. No. 4,211,347 (Mildern) is somewhat similar but requires dual sealing gaskets. U.S. Pat. No. 3,610,481 (Marraffino) requires two sealing gaskets in a co-dispenser and notes that where the two gaskets are relatively thin flat gaskets, a compression spring may additionally be needed to close the valve. U.S. Pat. No. 3,257,035 (Jones) illustrates a valve configuration with a dip tube, wherein a gasket sits in a groove but does not close a valve orifice into the stem. The gasket is said to tend to return, but may not return, an actuated valve stem to its non-actuated position, in a container system where product discharge continues through the valve stem until the container is empty regardless of the return of the stem to its non-actuated position. This latter patent accordingly does not require a return spring, but only a means to keep the valve closed until its initial actuation, and the valve is not easy to open because of the frictional engagement of a valve stem and surrounding sleeve.

It is further known to dispense viscous aerosol products from containers, such products including shaving gels, hair gels, bath and shower gels, and body lotion gels. The viscosity of such gels may range from 10,000 CPS (centipoise) to 50,000 CPS (centipoise) at room temperature, for example. Semi-viscous products such as hair mousses and whipped cream are also dispensed from aerosol containers. Such viscous gel products are generally not dispensed through dip tubes on the aerosol valve assemblies, and generally are dispensed from compartmentalized containers, wherein the propellant is in one compartment and the product to be dispensed is in a separate compartment. One common configuration of such compartmentalized containers has a movable piston in the aerosol can, with propellant below the piston and product above the piston with access to the aerosol valve. As product is dispensed from the aerosol valve, the propellant forces the piston upwardly to maintain pressure on the product. A second common configuration of such compartmentalized containers utilizes a collapsible, flexible bag attached to the aerosol valve housing or the can bead where the mounting cup is attached. The bag has access to the aerosol valve and contains the product to be dispensed. When the aerosol valve is actuated, propellant in the compartment between the bag and container inner wall acts to collapse the bag compartment and force product out the aerosol valve.

Semi-viscous products such as hair mousses and whipped cream likewise are not generally dispensed through dip tubes on the aerosol valve assemblies, and are generally dispensed from single compartment containers.

SUMMARY OF THE INVENTION

The present invention is intended to provide an easy-to-open aerosol valve assembly, characterized by the absence of a return spring, to dispense viscous products such as gels and semi-viscous products such as hair mousses and whipped cream from aerosol containers. The aerosol valve assembly is retained within a mounting cup, and includes a valve housing and a vertically-acting valve body with an upstanding stem. The stem has a central discharge passage, a groove extending into and encircling the outer wall of the stem, and one or more valve orifices extending through the stem wall in communication with the stem discharge passage and the stem groove. A single elastomeric gasket is captured between the valve housing and the mounting cup, has a central opening, and encircles and extends into the stem groove to seal the one or more stem valve orifices when the valve assembly is not actuated. The valve housing has a side wall encircling the valve body, and a bottom wall with both a central opening and a plurality of product delivery openings spaced outwardly from the bottom wall central opening. The valve body in turn has a lower portion which may be hollow and which extends downwardly through the valve housing bottom wall central opening to center and stabilize the vertical valve in the valve assembly. The valve body further has an intermediate outwardly extending portion positioned below the valve stem which overlies the valve housing bottom wall with its product delivery openings.

The product flow in the present invention extends upwardly from the valve housing bottom wall product delivery openings to a product passage between the valve housing side wall and the valve body, which passage extends upwardly to the at least one stem valve orifice and the stem discharge opening when the valve assembly is actuated. When the valve assembly is actuated, the portion of the gasket surrounding the gasket central opening is pushed downward by the stem groove so that the at least one stem valve orifice is no longer sealed. The gasket cannot completely escape the stem groove upon valve actuation, however, due to a stroke-limiting surface on the valve body that engages the valve housing upon a predetermined distance of downward movement of the valve body. The gasket portion of the gasket surrounding the gasket central opening accordingly remains partially within the stem groove upon actuation of the valve.

When actuation of the aerosol valve ceases, the valve is fully returned to its non-actuated, closed position by virtue of several important features of the present invention. First, the flexible single gasket when bent downward during actuation as previously described, acts to bias the top of the stem groove, and accordingly the stem and valve body, back to closed position wherein the gasket returns to its essentially non-flexed or flat position sealing the one or more stem orifices. Second, the viscous or semi-viscous product flows through the valve housing bottom wall product delivery openings, and acts upwardly against the valve body intermediate portion overlying the bottom wall. This in turn also biases the valve body upwardly. Third, the pressure of the viscous or semi-viscous product, acting upwardly on the valve body lower portion extending down through the valve housing bottom wall central opening, further biases the valve body upwardly. Fourth, the viscous or semi-viscous product flowing through the product passage between the valve housing side wall and the valve body exerts a considerable frictional force on the side wall of the valve body to bias the valve body upward. These various aspects of the present invention act together to assure a reliable closure of the aerosol valve assembly while eliminating any metal or plastic return spring. The absence of a return spring allows the valve assembly of the present invention to be opened and maintained open with considerably less user force. The latter is a desirable and perceived advantage to the consumer. In addition, there is none of the corrosion and other problems associated with metal and plastic return springs.

The design of the present invention is unique, simple and economical to manufacture and assemble. There are few parts, and the bottom wall of the valve housing may be sloped downwardly and inwardly so that the lower part of the valve body is easily guided into the central opening of the valve housing bottom wall upon assembly.

The present invention has particular applicability to viscous gel products dispensed from the afore-described compartmentalized container, but also may be used in single compartment containers with semi-viscous products. In neither case are product-carrying dip tubes required or used with the present invention.

Other features and advantages of the present invention will be apparent from the following description, drawings and claims.

DETAILED DESCRIPTION OF EMBODIMENT

Figure 1:
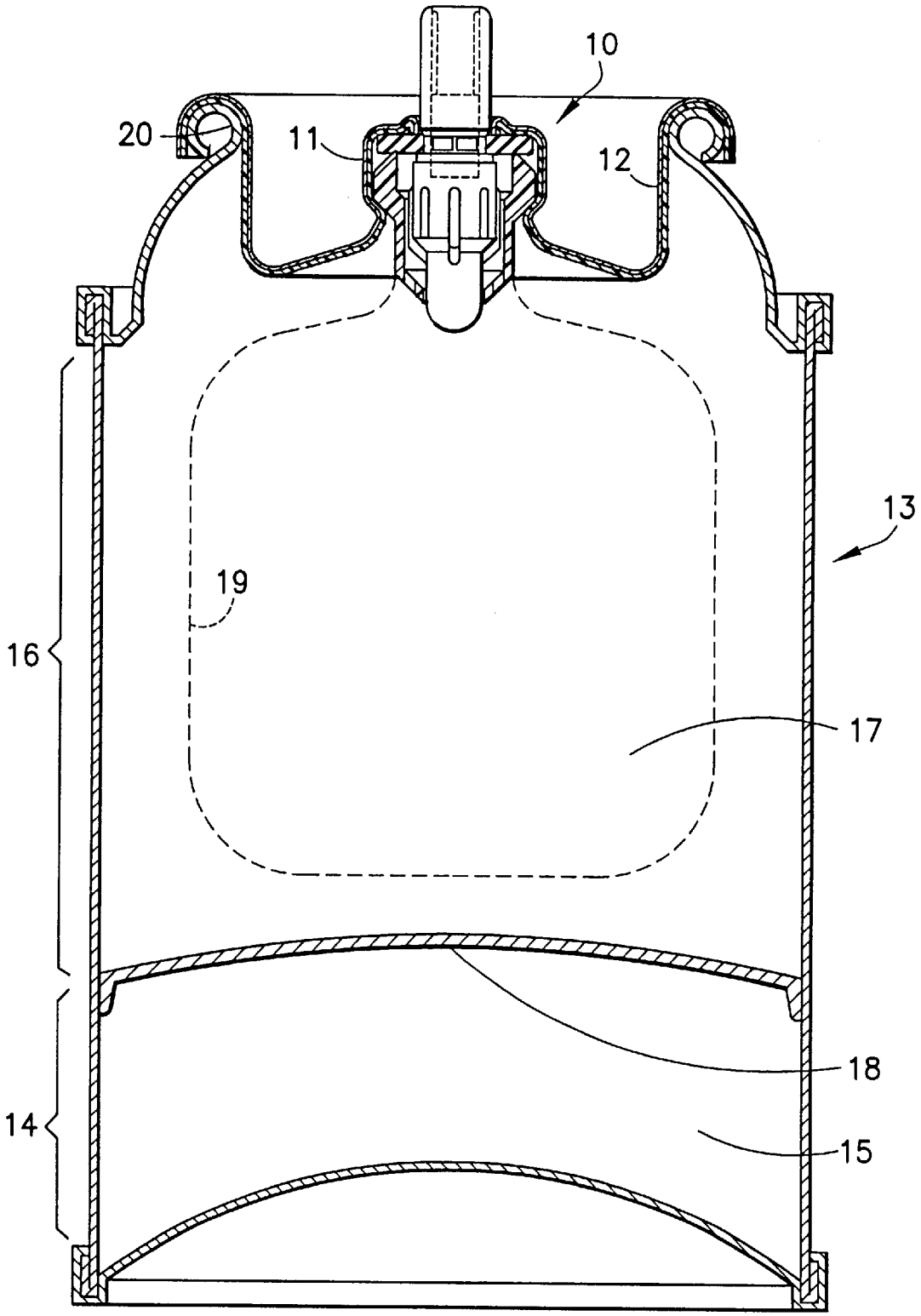
FIG. 1 is a side elevational view in partial section of the aerosol valve assembly of the present invention mounted within a compartmentalized aerosol container.

Referring to FIG. 1, an aerosol valve assembly designated generally as 10 is fitted and crimped into.the pedestal portion 11 of a metal mounting cup closure 12 for a pressurized aerosol container 13. Container 13 may be multi-compartmented, having a compartment 14 for holding a propellant 15 and a compartment 16 for holding a viscous or semi-viscous product 17 to be dispensed by the aerosol valve assembly 10. As shown in FIG. 1, compartment 14 lies below moveable piston 18 in container 13. When the aerosol valve is opened, propellant 15 in compartment 14 pushes piston 18 upward to force product 17 out the aerosol valve assembly 10. Alternatively, a collapsible bag 19 (shown in dotted line) may be mounted around the outside of the valve housing, or may be mounted between the container bead 20 and the overlying outside portion of the mounting cup clinched on the container bead. The bag 19 forms the compartment holding the product 17, the moveable piston 18 is eliminated, and the space between the bag outside wall and container inner wall forms the compartment holding the propellant. When the aerosol valve is opened, the propellant in the remainder of the container acts against the collapsible bag 19 to force product 17 out of the aerosol valve assembly 10 and progressively collapse bag 19 as this occurs. Container 13, as a further alternative, may be a single compartment containing both propellant and the aforementioned semi-viscous products to be dispensed.

Figure 2:
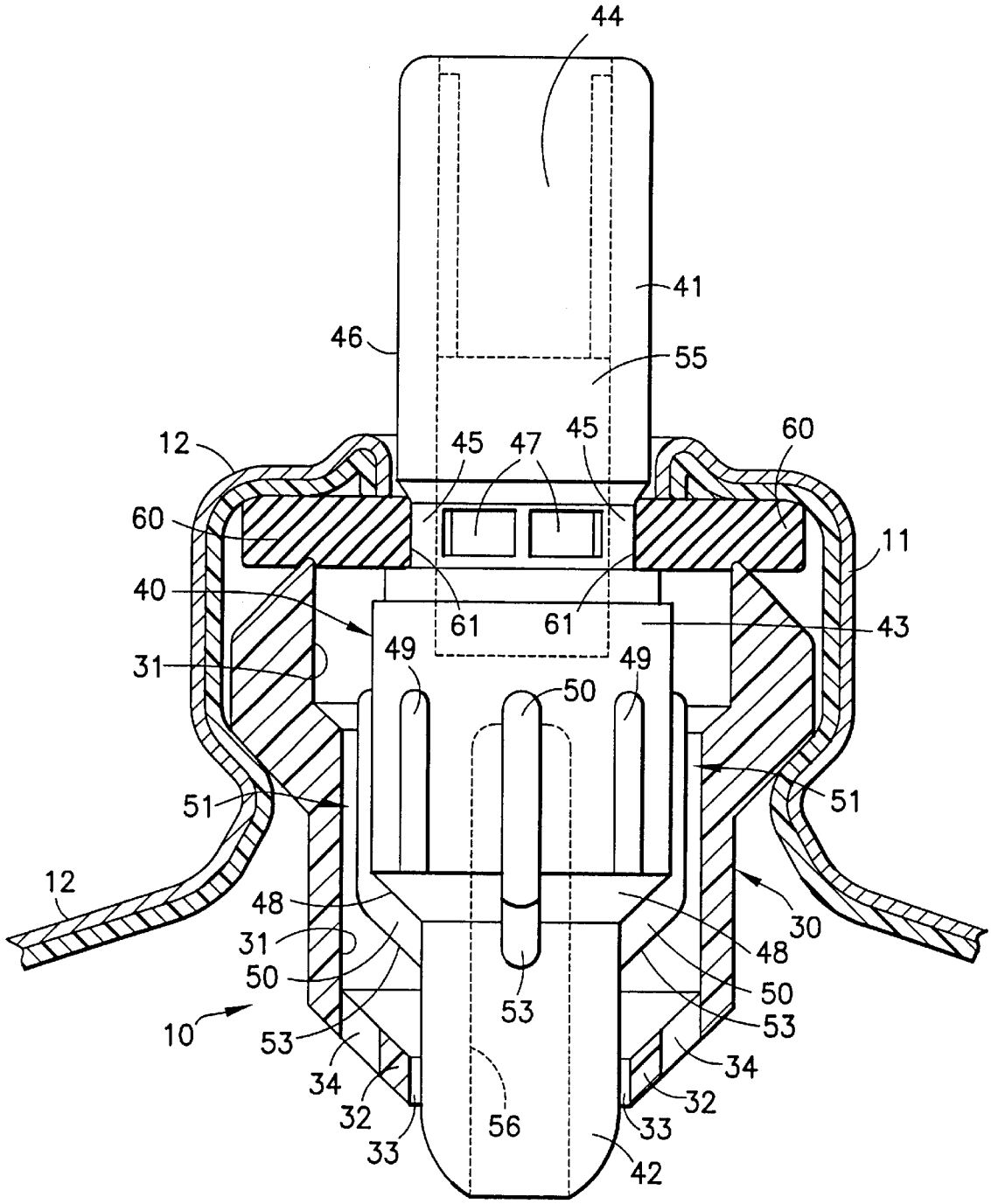
FIG. 2 is an enlarged side elevational view in partial section of the aerosol valve assembly of the present invention, the valve assembly being in closed position.

Now turning to FIGS. 2–8, the easy-to-open valve assembly 10 is importantly characterized by the lack of a valve return spring. Valve assembly 10 generally includes a valve housing 30, and a valve body 40 having integral upstanding valve stem 41, lower portion 42 and intermediate portion 43. Valve housing 30 and valve body 40 are generally circular in cross-section unless otherwise indicated and are plastic molded bodies. Any one of various conventional actuators (not shown) may be mounted on the top of valve stem 41. Valve stem 41 includes a central discharge passage 44, a stem groove 45 extending into and encircling the outer wall 46 of the stem, and one or more (four as shown) valve orifices 47 extending through the stem wall into communication with both the stem discharge passage 44 and the stem groove 45. Stem discharge passage 44 has a rib 55 bifurcating the lower portion of the discharge passageway, and two large rectangular valve orifices 47 extend into each of the two bifurcated sections. A single flat resilient elastomeric annular gasket 60 is shown in FIG. 2 captured between the valve housing 30 and the mounting cup 12. Gasket 60 has a central opening 61 (see FIG. 8), and in the unactuated valve position of FIG. 2, gasket 60 encircles and extends into stem groove 45 to seal the valve orifices 47.

Valve housing 30 has side wall 31 encircling the valve body 40, and downwardly and inwardly sloping bottom wall 32 having a central opening 33 and eight product delivery openings 34 spaced outwardly from central opening 33. Valve body lower portion 42 extends downwardly through the valve housing bottom wall central opening 33 and is only slightly spaced from the periphery of such opening 33 to allow relative vertical movement. Valve body 40 is a vertically acting valve, and valve body lower portion 42 serves to center and stabilize the valve body in the valve housing 30 against side-to-side movement. Upon assembly of the valve body 40 into the valve housing 30, the downwardly and inwardly sloping bottom wall 32 guides the valve body lower portion 42 into the central opening 33 of the valve housing 30. Valve body lower portion 42 may be hollow in its interior as shown at bore 56 to save material and to assist in molding and subsequent cooling of the valve body.

Valve body 40 as noted further includes intermediate portion 43 which extends outwardly and has downwardly and inwardly extending annular surface 48 that overlies the valve housing bottom wall 32 with its product delivery openings 34. Intermediate portion 43 also has a plurality of vertical ribs 49 and 50 spaced about its periphery which serve to center the valve body 40 in the valve housing 30. Ribs 50 extend lower than ribs 49 for a stroke-limiting purpose hereafter described.

Figure 3:
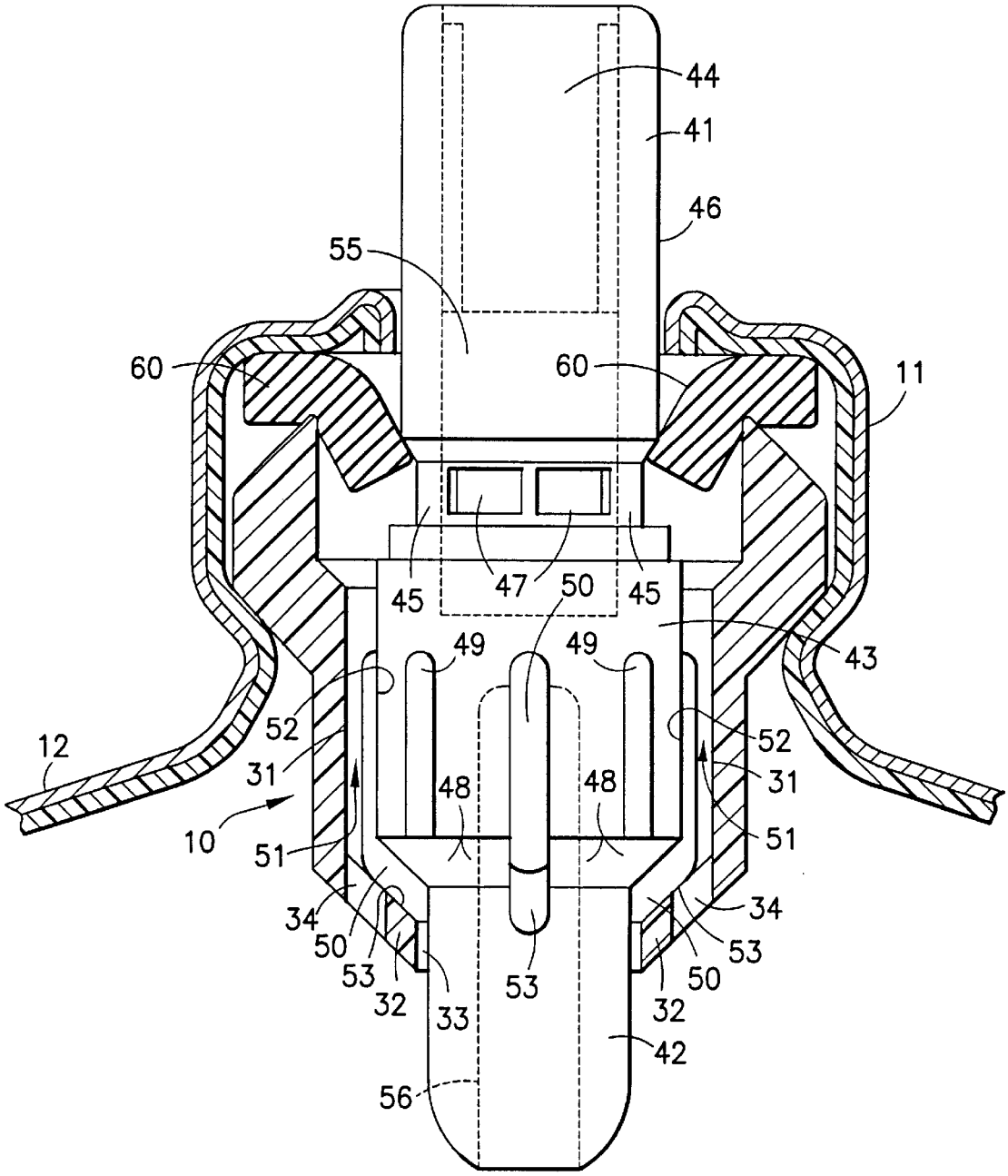
FIG. 3 is an enlarged side elevational view in partial section of the aerosol valve assembly of the present invention, the valve assembly being in open position.
Figure 4:
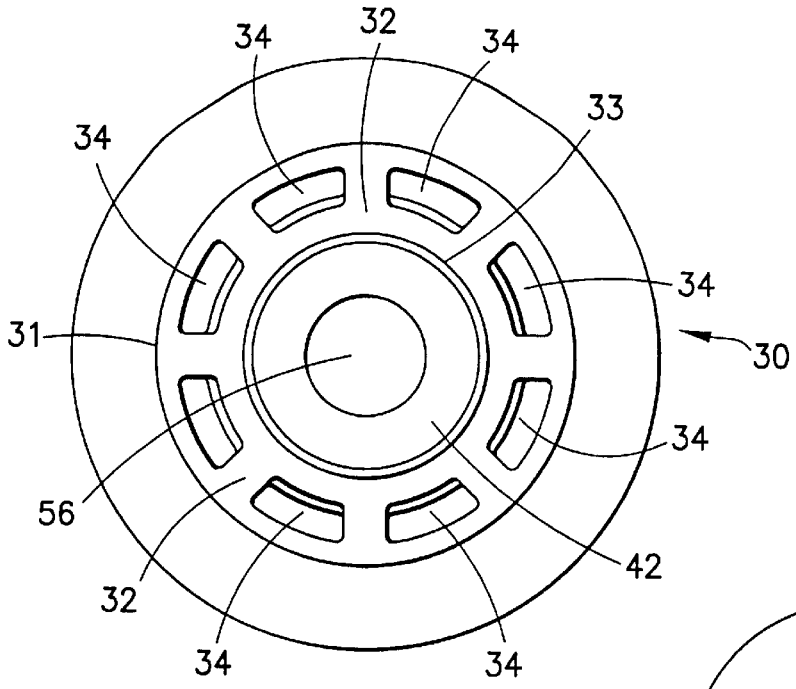
FIG. 4 is a bottom plan view of the assembled valve housing and valve body of the present invention with the gasket and mounting cup removed.
Figure 8:
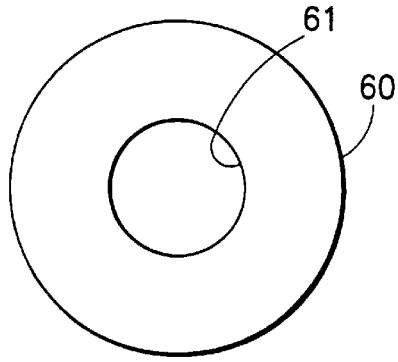
Figure 5:
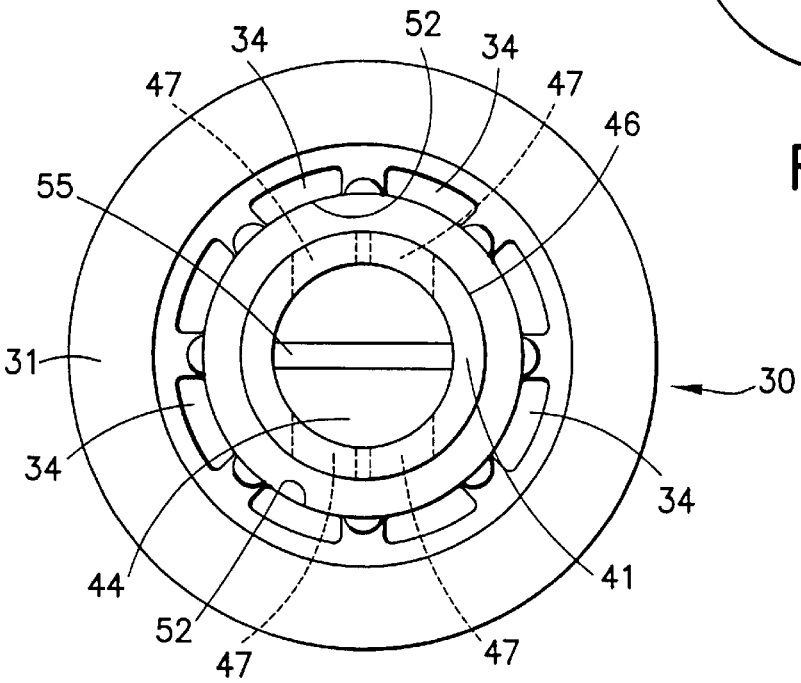
FIG. 5 is a top plan view of the assembled valve housing and valve body of the present invention with the gasket and mounting cup removed.
Figure 6:
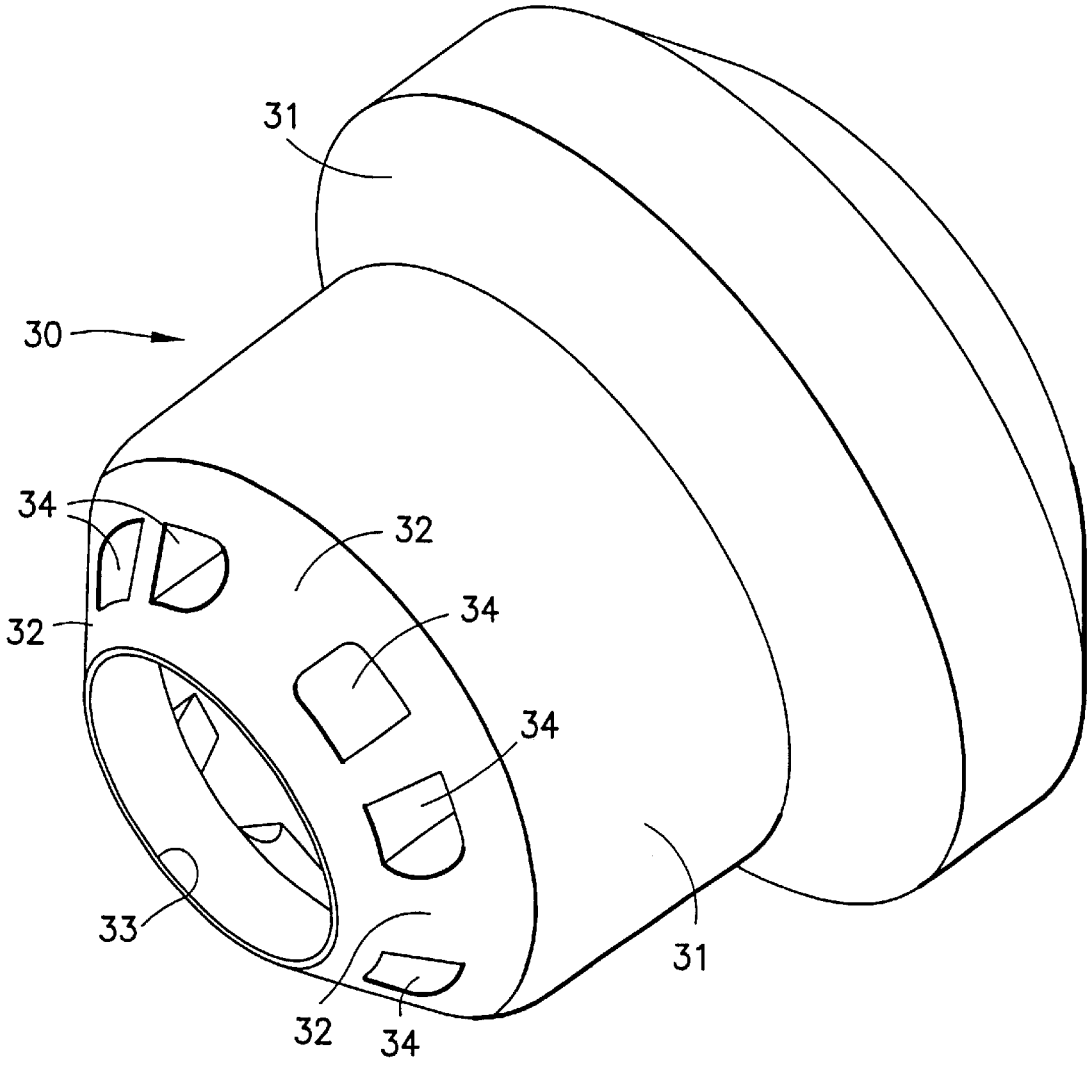
FIG. 6 is a perspective view of the valve housing of the present invention.
Figure 7:
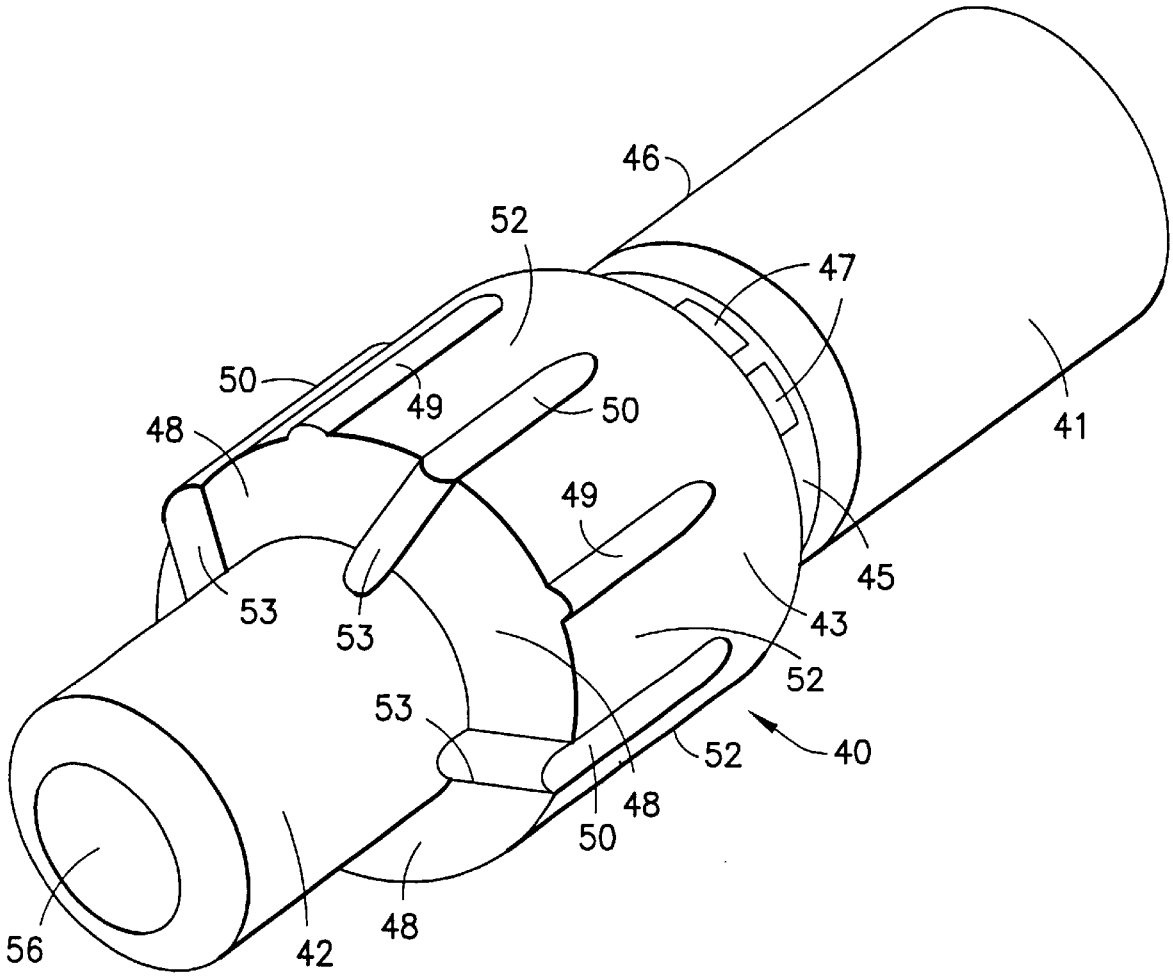
FIG. 7 is a perspective view of the valve body of the present invention; and, FIG. 8 is a plan view of the valve sealing gasket of the present invention.

Now referring to FIG. 3, the aerosol valve assembly 10 of the present invention is shown in the actuated position with the valve body depressed vertically downward by the user. A product flow passage is now created upwardly through the product delivery openings 34 in the valve housing bottom wall 32; up against and along annular surface 48 of the valve body intermediate portion 43; upwardly in the relatively narrow annular space 51 between inner side wall 31 of the valve housing 30 and the outer side wall 52 of the valve body intermediate portion 43; into the uncovered stem groove 45 and the stem valve orifices 47; and, up through and out of the stem central discharge passage 44. It will be noted that the portion of gasket 60 surrounding the gasket central opening 61 has been pushed downwardly by the upper shoulder of stem groove 45; however, the gasket 60 has not completely escaped stem groove 45 and continues to exert pressure and an upward bias on the top of stem groove 45 as shown in FIG. 3. Gasket 60 is not allowed to fully escape groove 45 because of the presence of ribs 50 on valve body 40. When the valve body is actuated by depressing it as shown in FIG. 3, the bottom stroke-limiting surfaces 53 of the four ribs 50, which slant downwardly and inwardly, come into contact with the downwardly and inwardly sloping bottom wall 32 of valve housing 30. This stops the downward actuation stroke of the valve body before gasket 60 fully exits stem groove 45 as shown in FIG. 3. Further, product flow spacing is left between housing bottom wall 32 and annular surface 48 of the valve body.

When the aerosol valve assembly 10 is no longer actuated, valve body 40 fully and reliably returns to its non-actuated closed position because of several features of the present invention. First, as noted above, the flexible gasket 60 in the FIG. 3 position acts to bias the stem groove (and accordingly the entire valve body 40) upwardly toward the FIG. 2 position wherein the gasket 60 returns to its flat, sealing position. Second, the viscous or semi-viscous product flow through valve housing bottom wall product delivery openings 34 and up against annular surface 48 of the valve body intermediate portion 43, also acts to bias the valve body 40 upwardly toward the FIG. 2 position. Third, the viscous or semi-viscous product exerts pressure upwardly against the outside rounded surface of valve body lower portion 42 and against the interior upper wall of the bore 56 of body lower portion 42, to also bias the valve body 40 upwardly toward the FIG. 2 position. Fourth, the viscous or semi-viscous product flow upwardly through the relatively narrow annular space 51 between the valve housing and valve body, creates a considerable frictional force on the side wall 52 of the valve body to further draw the valve body upwardly toward the FIG. 2 portion. These several features brought about by the unique and simple design of the present invention assure a reliable closure in an easy-to-open aerosol valve assembly characterized by the lack of a return spring. The unique design is also simple to manufacture and assemble as readily apparent from the above description and drawings.

In a sample embodiment of the present invention, the following nominal dimensions may be used:

Diameter of central opening 33 in housing bottom wall 32 –0.140 inches

Diameter of valve body lower portion 42 –0.130 inches

Angle of valve housing bottom wall 32 –45 degrees

Maximum stroke of valve body 40 –0.062 inches

Inner diameter of valve housing side wall 31 –0.228 inches

Outer diameter of valve body intermediate wall 43 –0.193 inches.

It will be appreciated by persons skilled in the art that variations and/or modifications may be made to the present invention without departing from the spirit and scope of the invention. The present embodiment is, therefore, to be considered as illustrative and not restrictive. It should also be understand that such terms as "upper", "lower" "inner", "outer" "exterior", "interior", "vertical", "side", "top", "bottom", "central", "upstanding", "encircling", "surrounding", "inwardly", "outwardly", "upwardly" "downwardly", "above", "below", "overlying", and corresponding similar positional terms as used in the specification are used and intended in relation to the positioning shown in the drawings, and are not otherwise intended to be restrictive.

What is claimed is:

1. An easy-to-open aerosol valve assembly to dispense viscous and semi-viscous products from an aerosol container, said valve assembly being retained within a mounting cup and characterized by the absence of a return spring, comprising in combination: a valve housing; a valve body having an upstanding valve stem, the valve stem having a discharge passage, a stem groove extending into and encircling the outer wall of the stem, and at least one valve orifice extending through the stem wall into communication with both the stem discharge passage and the stem groove; a gasket captured between the valve housing and mounting cup, having a central opening, and encircling and extending into the stem groove to seal the at least one valve orifice when the aerosol valve assembly is not being actuated; such valve housing having a side wall encircling the valve body, and a bottom wall having a central opening and a plurality of product delivery openings spaced outwardly from said central opening; said valve body having a lower portion extending downwardly into the valve housing bottom wall central opening, and an intermediate outwardly extending portion positioned below the valve stem and overlying the valve housing bottom wall with its product delivery openings; an upwardly extending product passage between the valve housing side wall and the valve body extending from said valve housing bottom wall product delivery openings upwardly to said at least one stem valve orifice and stem discharge passage when the valve assembly is actuated and the portion of the gasket surrounding the gasket central opening is accordingly pushed downwardly by the stem groove; at least one stroke-limiting surface on the valve body for engaging the valve housing upon a predetermined distance of downward movement of the valve body to prevent the gasket completely escaping the stem groove upon valve assembly actuation; and, said gasket acting upwardly against the stem groove and said viscous or semi-viscous product acting upwardly against the valve body, upon valve assembly actuation, thereby moving the valve body upwardly to a closed valve position when the valve assembly is released from its actuated position.

2. The aerosol valve assembly of claim 1, wherein said at least one stroke-limiting surface on the valve body comprises a plurality of ribs on the exterior surface of the valve body that engage the valve housing bottom wall upon said predetermined distance of downward movement of the valve body.

3. The aerosol valve assembly of claim 1, wherein said valve body lower portion extends through the valve housing bottom wall central opening.

4. The aerosol valve assembly of claim 1, wherein said valve body lower portion has a hollow base and an interior wall within the hollow base against which the viscous or semi-viscous product acts upwardly to urge the valve body upwardly.

5. The aerosol valve assembly of claim 1, wherein the valve housing bottom wall at its central opening is narrowly spaced from the valve body lower portion to allow said lower portion to move through said central opening while preventing any substantial side-to-side valve body motion.

6. The aerosol valve assembly of claim 1, wherein at least a portion of the upwardly extending product passage between the valve housing side wall and the valve body is relatively narrow in its side to side dimension whereby the friction of the viscous or semi-viscous product flowing through said upwardly extending product passage acts to urge the valve body upwardly.

7. The aerosol valve assembly of claim 1, further characterized by the absence of a product-carrying dip tube.

8. The aerosol valve assembly of claim 1, wherein the valve housing bottom wall slopes inwardly and downwardly from the valve housing side wall.

9. The aerosol valve assembly of claim 8, wherein the valve body intermediate outwardly extending portion has a surface sloping inwardly and downwardly toward said valve body lower portion, said surface overlying said valve housing bottom wall with its product delivery openings whereby product upon dispensing passes through said delivery openings and impinges upon said surface to urge the valve body upwardly.

10. The aerosol valve assembly of claim 1, further including a multi-component aerosol container having a first compartment for propellant, and a second compartment for product open to the valve housing bottom wall product delivery openings for the viscous or semi-viscous product to be dispensed from the aerosol valve assembly.

11. The aerosol valve assembly of claim 10, wherein the first and second compartments are separated by a movable piston in the container.

12. The aerosol valve assembly of claim 10, wherein the second compartment is a flexible bag.

13. An aerosol package including an aerosol container, a mounting cup closing the container, an easy-to-open aerosol valve assembly retained within the mounting cup and characterized by the absence of a return spring, and a viscous or semi-viscous product in the container; said aerosol valve assembly comprising: a valve housing; a valve body having an upstanding valve stem, the valve stem having a discharge passage, a stem groove extending into and encircling the outer wall of the stem, and at least one valve orifice extending through the stem wall into communication with both the stem discharge passage and the stem groove; a gasket captured between the valve housing and mounting cup, having a central opening, and encircling and extending into the stem groove to seal the at least one valve orifice when the aerosol valve assembly is not being actuated; such valve housing having a side wall encircling the valve body, and a bottom wall having a central opening and a plurality of product delivery openings spaced outwardly from said central opening; said valve body having a lower portion extending downwardly into the valve housing bottom wall central opening, and an intermediate outwardly extending portion positioned below the valve stem and overlying the valve housing bottom wall with its product delivery openings; an upwardly extending product passage between the valve housing side wall and the valve body extending from said valve housing bottom wall product delivery openings upwardly to said at least one stem valve orifice and stem discharge passage when the valve assembly is actuated and the portion of the gasket surrounding the gasket central opening is accordingly pushed downwardly by the stem groove; at least one stroke-limiting surface on the valve body for engaging the valve housing upon a predetermined distance of downward movement of the valve body to prevent the gasket completely escaping the stem groove upon valve assembly actuation; and, said gasket acting upwardly against the stem groove and said viscous or semi-viscous product acting upwardly against the valve body, upon valve assembly actuation, thereby moving the valve body upwardly to a closed valve position when the valve assembly is released from its actuated position.

14. The aerosol package of claim 13, wherein the aerosol container has a first compartment for propellant and a second compartment for product, said second compartment being open to the valve housing bottom wall product delivery openings.

15. The aerosol package of claim 13, further characterized by the absence of a product-carrying dip tube.

* * * * *